US007287345B2

(12) United States Patent
Cooper

(10) Patent No.: US 7,287,345 B2
(45) Date of Patent: Oct. 30, 2007

(54) MEMORIAL DISPLAY

(75) Inventor: Tom Cooper, 200 Ida St., Battle Creek, IA (US) 51006-9115

(73) Assignee: Tom Cooper, Battlecreek, IA (US)

( * ) Notice: Subject to any disclaimer, the term of this patent is extended or adjusted under 35 U.S.C. 154(b) by 0 days.

(21) Appl. No.: 11/205,835

(22) Filed: Aug. 17, 2005

(65) Prior Publication Data

US 2007/0113431 A1 May 24, 2007

(51) Int. Cl.
*G09F 19/00* (2006.01)

(52) U.S. Cl. ..... 40/124.5; 40/607.05; 248/512; 248/530

(58) Field of Classification Search ..... 40/124.5, 40/218, 607.05, 610, 611.01, 607.01; 248/512, 248/513, 530, 539, 523, 533
See application file for complete search history.

(56) References Cited

U.S. PATENT DOCUMENTS

| | | | | |
|---|---|---|---|---|
| 1,612,357 | A | | 12/1926 | Brown |
| 1,674,565 | A | | 6/1928 | Peterson |
| 1,676,637 | A | | 7/1928 | Bona et al. |
| 1,926,468 | A | | 9/1933 | Vogelpohl |
| 2,854,147 | A | * | 9/1958 | Derr ..... 211/70.8 |
| D185,807 | S | | 8/1959 | Antle |
| 3,570,676 | A | | 3/1971 | Crosslen |
| 3,608,220 | A | | 9/1971 | Fryrear |
| 3,977,110 | A | * | 8/1976 | Yerger ..... 40/124.5 |
| 4,176,819 | A | * | 12/1979 | Lowe ..... 248/513 |
| 4,300,690 | A | | 11/1981 | Thomas |
| 4,455,772 | A | | 6/1984 | Miller |
| 4,865,287 | A | * | 9/1989 | Stoudt ..... 248/513 |
| 4,881,674 | A | * | 11/1989 | Medianik ..... 224/311 |
| 6,068,135 | A | | 5/2000 | Holtzrager |
| 6,142,313 | A | | 11/2000 | Young |
| 6,360,902 | B1 | * | 3/2002 | Searles ..... 211/70.8 |
| 2002/0184798 | A1 | | 12/2002 | McGovern |
| 2004/0139633 | A1 | | 7/2004 | Shannon |

* cited by examiner

*Primary Examiner*—Cassandra Davis
(74) *Attorney, Agent, or Firm*—Emily E. Harris; Davis, Brown Law Firm

(57) ABSTRACT

A gravesite memorial display is provided which includes a display rack and support post. The display rack displays items that depict hobbies, interests, and achievements of the deceased. The gravesite memorial display also includes an anti-theft bar that prevents theft of memorial items.

15 Claims, 7 Drawing Sheets

MEMORIAL DISPLAY

BACKGROUND OF THE INVENTION

The invention relates generally to a gravesite memorial display and, more particularly, to a gravesite memorial display for use in displaying items that were significant to the deceased.

Headstones at gravesites generally contain a deceased's name and birth and death dates, but rarely contain any information particular to the life of the deceased, such as achievements or interests. Loved ones and friends often desire a more specific reminder of the life of the deceased when they visit the cemetery. Friends and family may also want a display at the gravesite that informs other visitors of the life of the deceased.

Specifically, it may be desired that a memorial display include information about the hobbies, awards, family, and job of the deceased. This information is too detailed to be included on a headstone or other grave marker.

SUMMARY OF THE INVENTION

An object of the present invention is to provide a gravesite memorial display.

A further object of the present invention is to provide a gravesite memorial display that displays items of significance to the deceased.

These and other objects of the present invention will become apparent to those skilled in the art upon reference to the following specification, drawings, and claims.

The present invention intends to overcome the difficulties encountered heretofore. To that end, a gravesite memorial display is provided which includes a display rack and support post is provided. The display rack displays items that depict hobbies, interests, and achievements of the deceased. The gravesite memorial display also includes an anti-theft bar that prevents theft of memorial items.

DETAILED DESCRIPTION OF THE INVENTION

Figure 1:
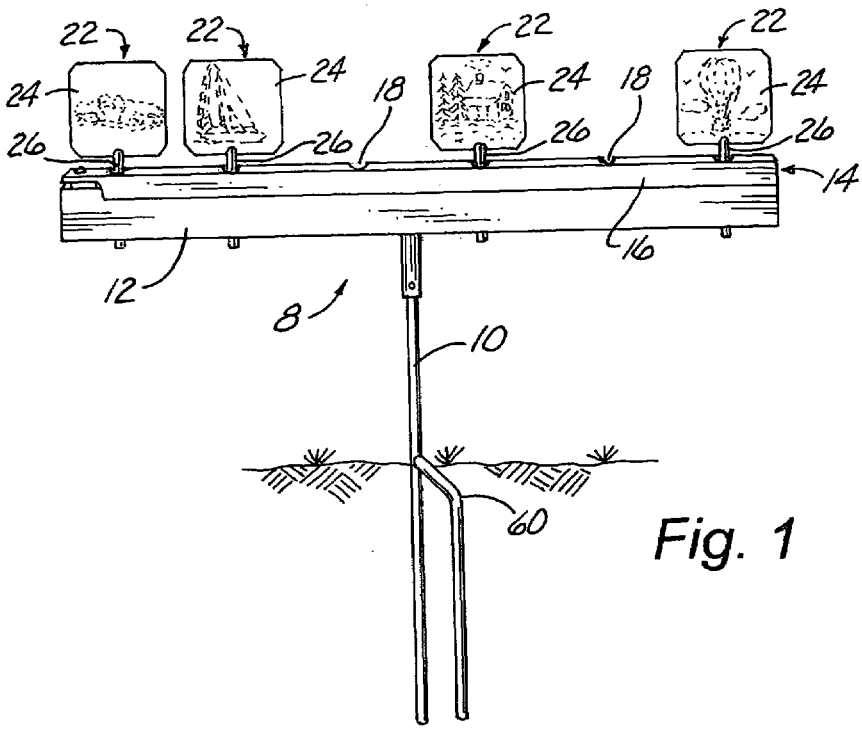
FIG. 1 is a view of the memorial display of the present invention.

Illustrated generally in FIG. 1 is the memorial display 8 of the present invention. The memorial display 8 includes a support 10 that supports a rack 12. The rack has openings 13 that receive items 22 for display.

Figure 6:
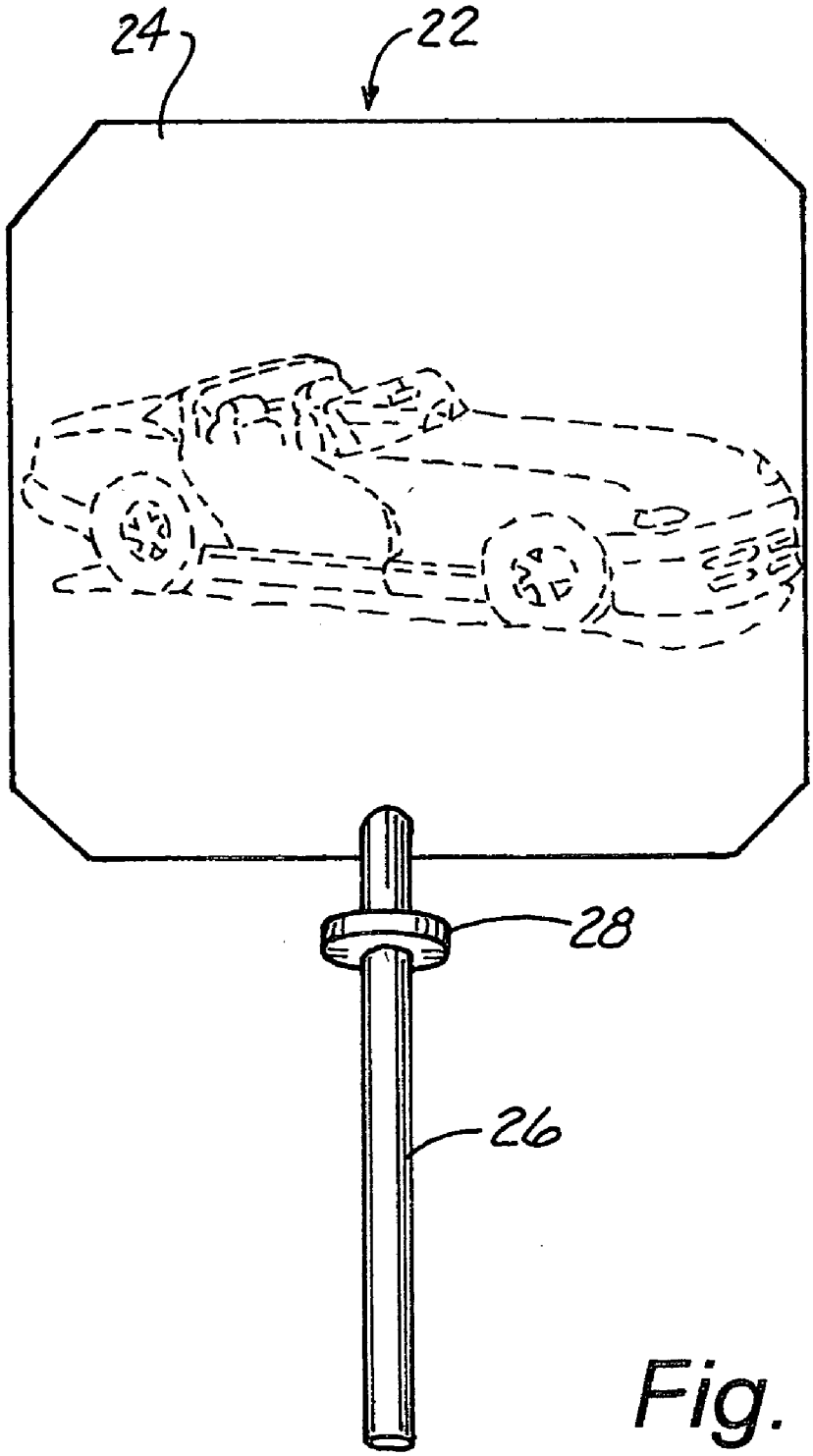
FIG. 6 is a view of a memorial placard of the present invention.
Figure 7:
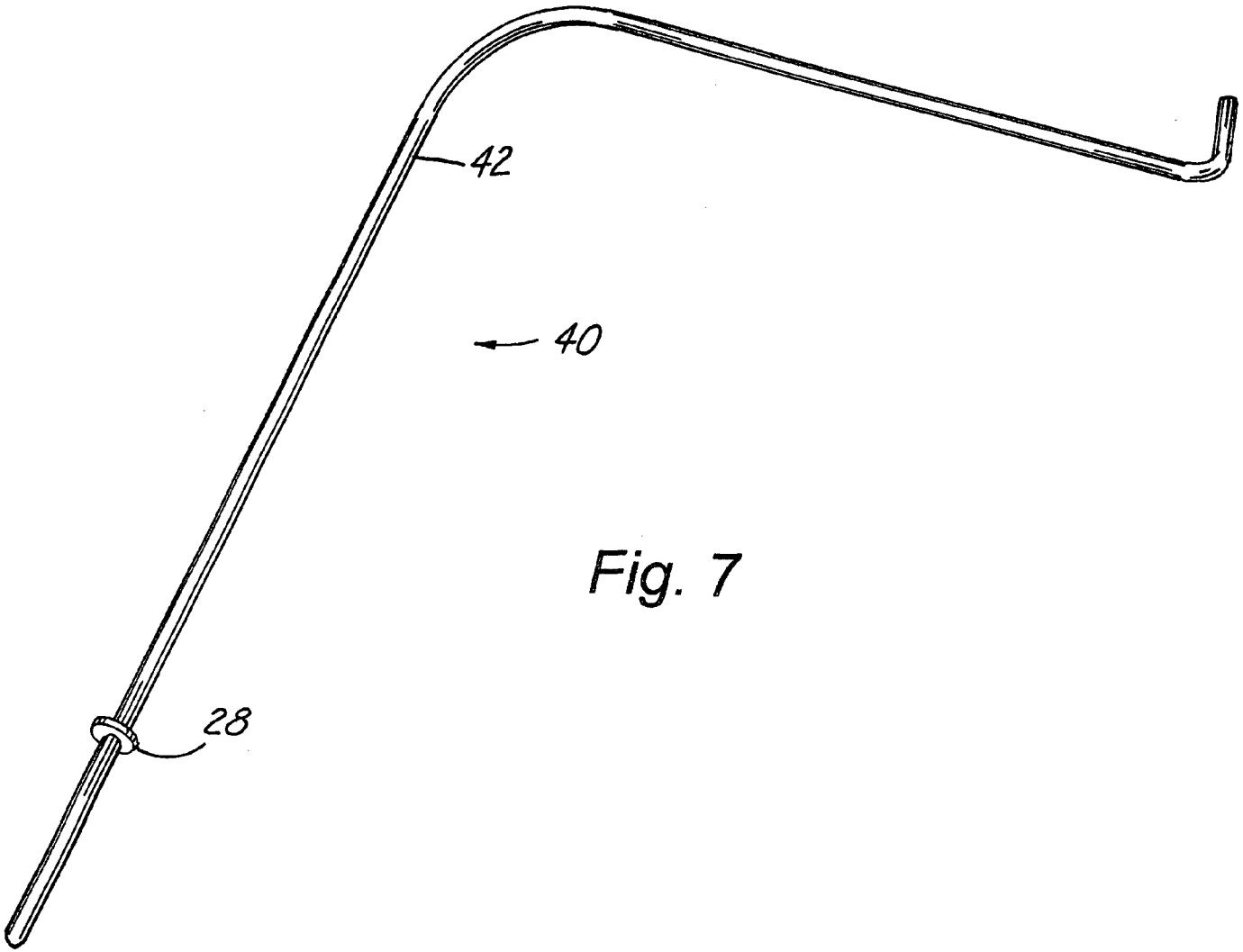
FIG. 7 is a view of a flag post for use in the present invention.

A typical memorial item 22 is shown in FIG. 6. The memorial item 22 includes a placard 24 that displays an image or picture of an item of significance to the deceased. The placard 24 is supported by a post 26. The post 26 fits into the openings 13 on the rack 12. The post 26 also has a washer 28. A second type of support 40 is seen in FIG. 7. Instead of having the placard 24, the support 40 includes a curved bar 42 to hold a flag (not pictured). This second type of support 40 also includes a washer 28.

Figure 2:
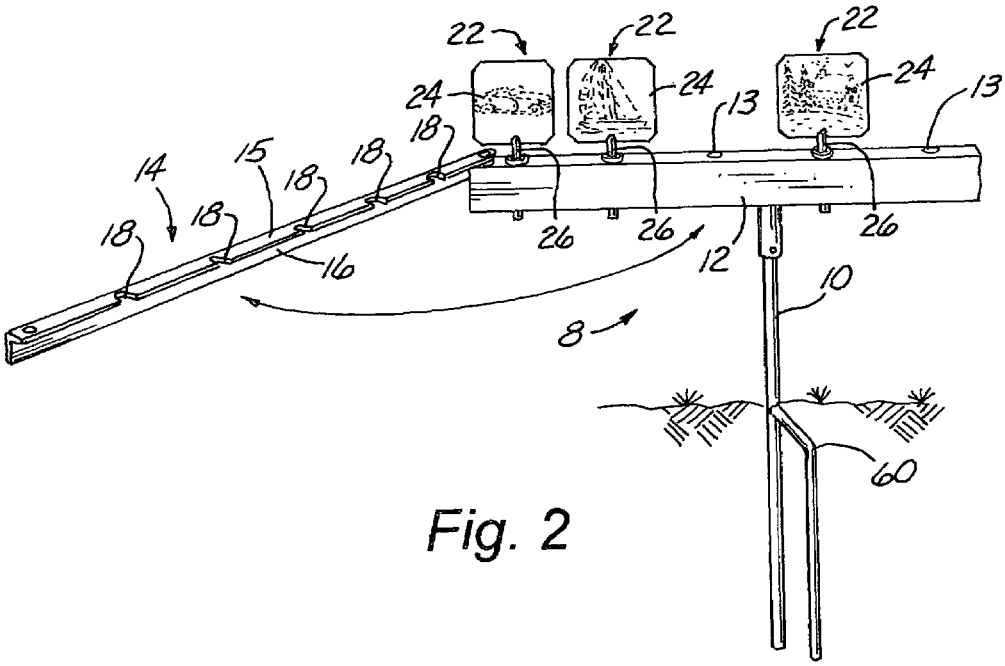
FIG. 2 is a view of the safety latch of the memorial display of the present invention.
Figure 3:
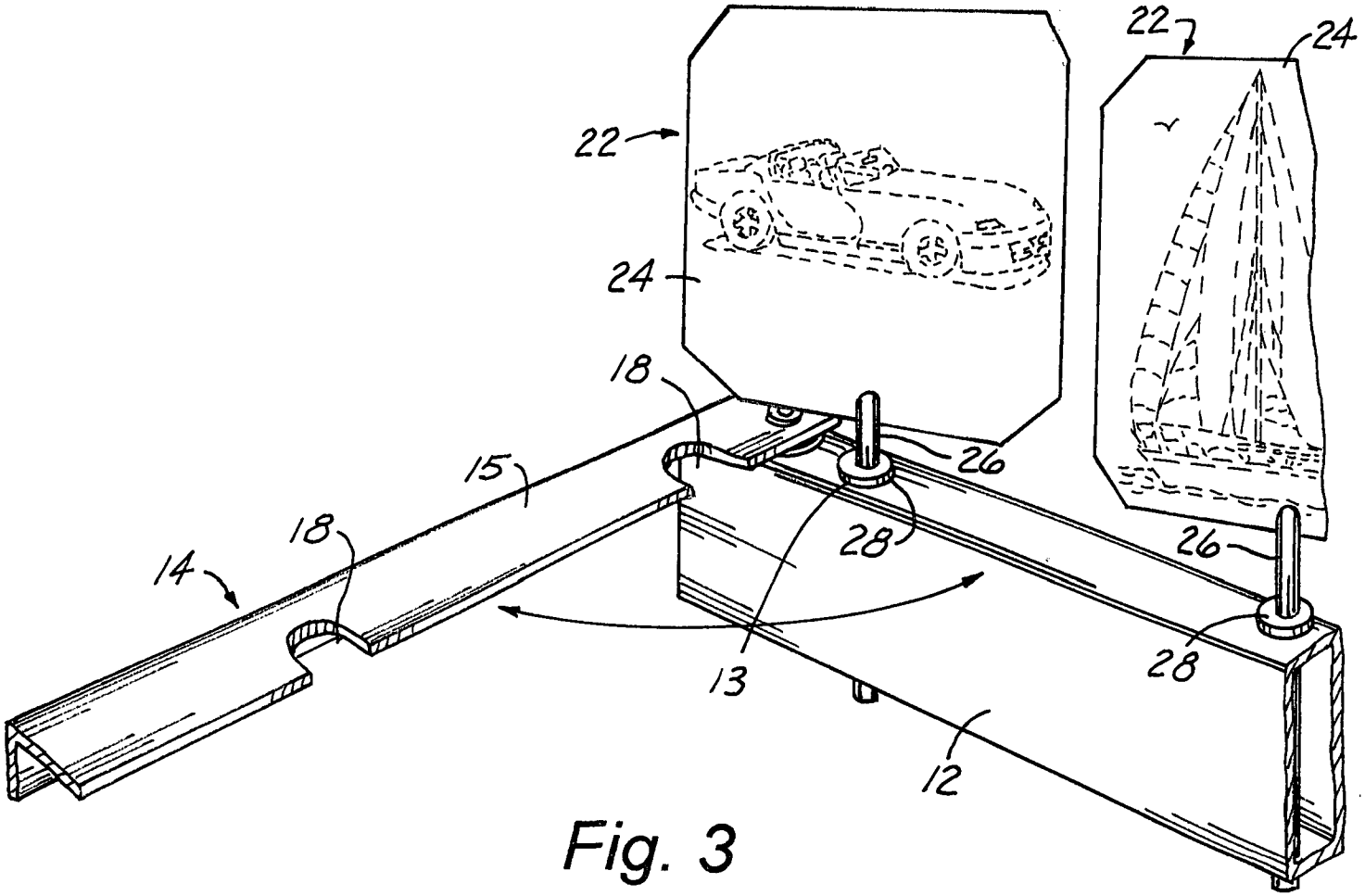
FIG. 3 is a close view of the safety latch of the memorial display of the present invention.
Figure 4:
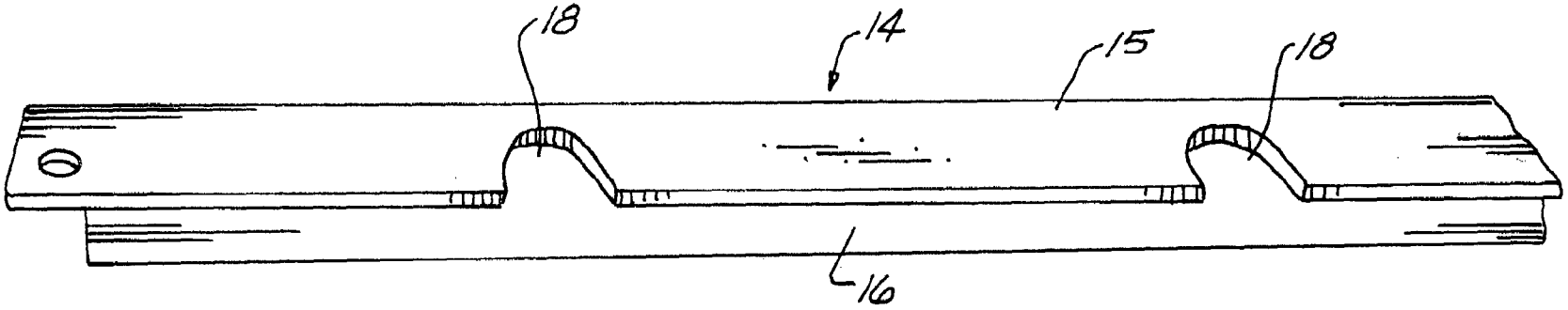
FIG. 4 is a close view of the safety latch of the present invention.

Attached to the rack 12 is an anti-theft bar 14 that secures the memorial items 22 to the rack 12. The bar 14 is pivotally attached to the rack 12 at one end of the rack 12. As seen in FIGS. 2-4, the bar 14 has a top 15 and a side 16. The top 15 has openings 18 at the locations of the memorial items 22 on the rack 12. The top 15 slides over the rack 12 and is secured at each end of the rack 12 by screws, bolts, or any other means for attachment. The bar 14 can be secured on the top 15 of the bar or the side 16. When memorial items 22 are in the rack 12, the top 15 slides over the top of the washer 28 on the post 26 of the memorial item 22. Once the bar 14 is secured at the ends of the rack 12, the memorial items 22 cannot be removed from the rack 12 because they are held in place by the washer 28 and the top 15 of the bar 14.

Figure 5:
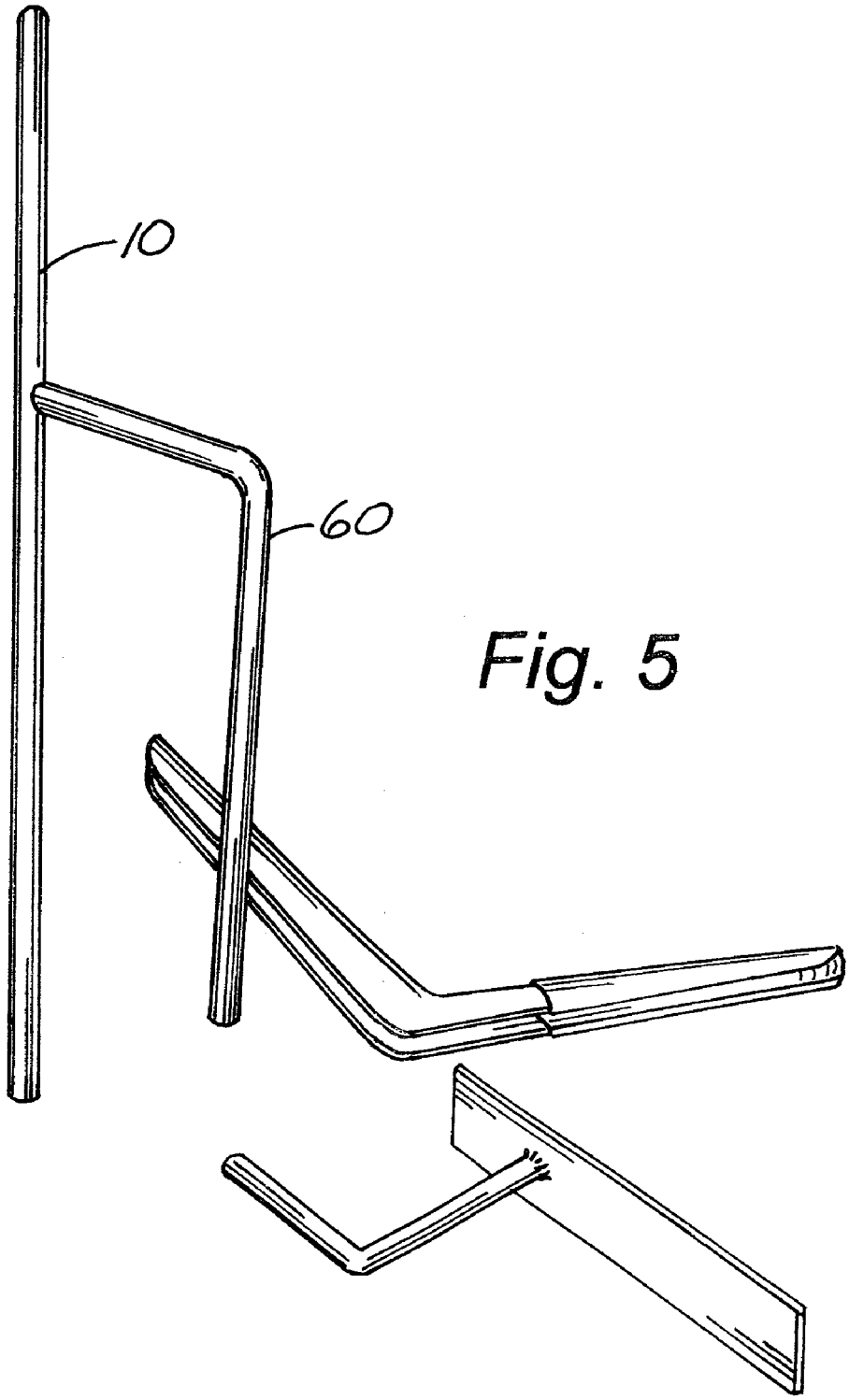
FIG. 5 is a view of the support post of the present invention.
Figure 8:
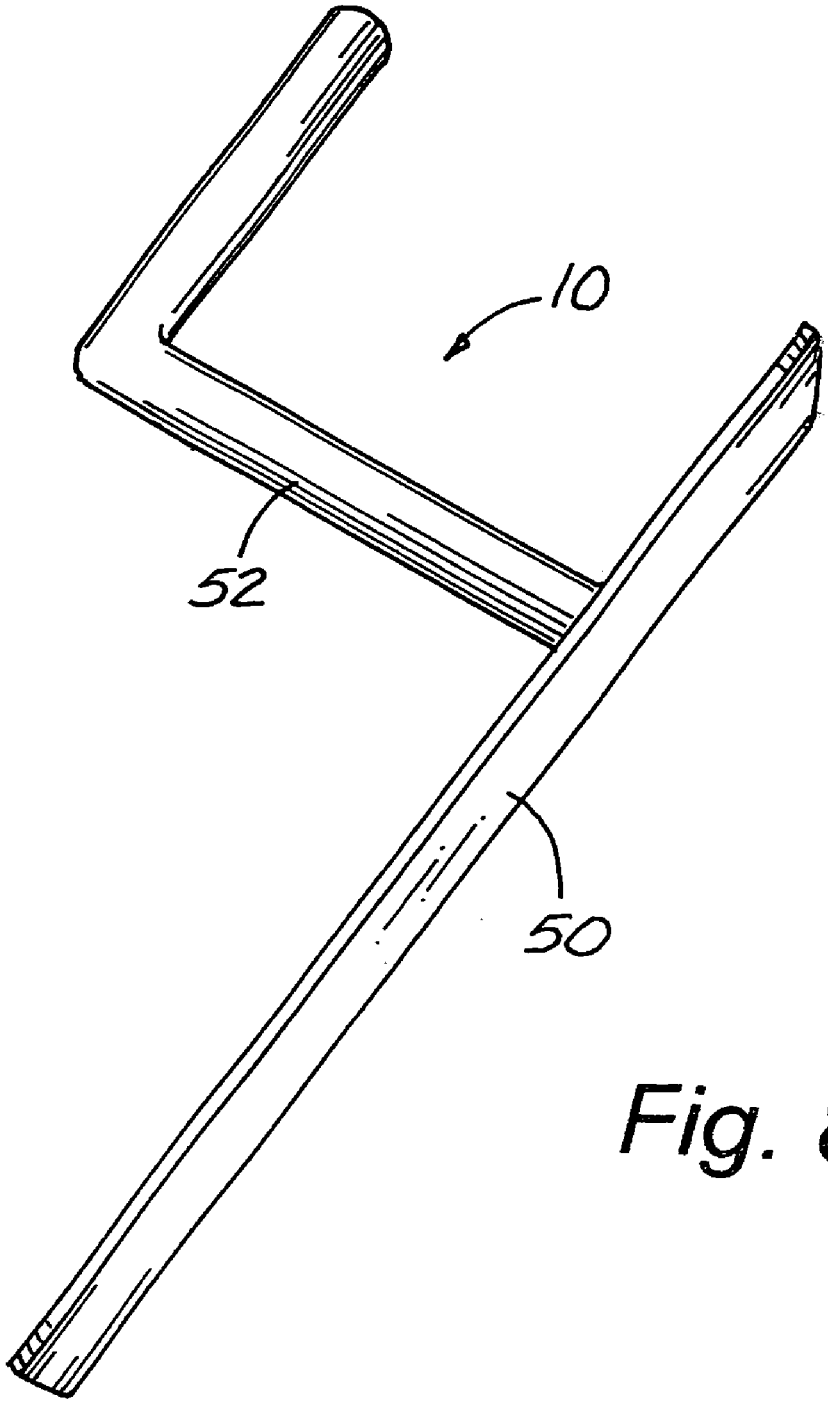
FIG. 8 is a view of an alternative support post for use in the present invention.

FIGS. 5 and 8 show two embodiments of the support post 10 of the present invention. FIG. 5 depicts a post 10 that is inserted into the ground. The post 10 includes a stabilizing arm 60 that helps anchor the memorial display 8 in the ground. FIG. 8 depicts a support post that can be attached to a headstone, shepard's hook, or other fixture at the gravesite. In this embodiment, the flat bar 50 is attached to the headstone or other fixture and the rack 12 attaches to the generally L-shaped support post 52.

The foregoing description and drawings comprise illustrative embodiments of the present inventions. The foregoing embodiments and the methods described herein may vary based on the ability, experience, and preference of those skilled in the art. Merely listing the steps of the method in a certain order does not constitute any limitation on the order of the steps of the method. The foregoing description and drawings merely explain and illustrate the invention, and the invention is not limited thereto, except insofar as the claims are so limited. Those skilled in the art who have the disclosure before them will be able to make modifications and variations therein without departing from the scope of the invention.

The invention claimed is:

1. A gravesite memorial display comprising:

a) a support post;

b) a horizontally extending rack removably attached to said support post, wherein said rack includes at least one opening adapted to hold at least one memorial item;

c) a securing bar pivotally connected to said rack, wherein the securing bar extends substantially the length of the rack; and d) at least one removable memorial item adapted to be inserted in said rack.

2. The gravesite memorial display of claim 1 wherein the memorial item further comprises a placard and a post with a washer, wherein the opening in the rack receives the memorial item post.

3. The gravesite memorial display of claim 2 wherein the securing bar slides over the washer of the memorial item.

4. The gravesite memorial display of claim 1 wherein the memorial item further comprises a flag post, wherein the opening in the rack receives the flag post.

5. The gravesite memorial display of claim 4 wherein the flag post includes a washer.

6. The gravesite memorial display of claim 5 wherein the securing bar slides over the washer of the flag post.

7. The gravesite memorial display of claim 1 wherein the support post is inserted into the ground.

8. The gravesite memorial display of claim 1 wherein the support post is mounted to a fixture.

9. The gravesite memorial display of claim 1, wherein the memorial item further comprises an ornament.

10. A method of displaying memorial items at a gravesite comprising:

(a) providing a support post;

(b) providing a horizontally extended rack connected to the support post, wherein said rack includes at least one opening adapted to hold at least one memorial item;

(c) inserting at least one memorial item into the opening in the rack; and (d) securing the memorial items in the rack with a securing bar, wherein the securing bar extends substantially the length of the rack.

11. The gravesite memorial display of claim 1, wherein the memorial item further comprises a post and a securing means, wherein the opening in the rack receives the memorial item post.

12. The gravesite memorial display of claim 11, wherein the securing bar slides over the securing means of the memorial item.

13. The gravesite memorial display of claim 1, wherein the memorial item further comprises an image.

14. The gravesite memorial display of claim 1, wherein the memorial item further comprises a replica.

15. The gravesite memorial display of claim 1, wherein the memorial item comprises a placard.

* * * * *